US007498552B2

(12) United States Patent
Kraemer

(10) Patent No.: US 7,498,552 B2
(45) Date of Patent: Mar. 3, 2009

(54) CALIBRATABLE MICROWAVE CIRCUIT WITH ILLUMINABLE GAAS-FET, CALIBRATING DEVICE AND PROCESS

(75) Inventor: Wilhelm Kraemer, Bad Reichenhall (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 90 days.

(21) Appl. No.: 10/575,741

(22) PCT Filed: Apr. 22, 2005

(86) PCT No.: PCT/EP2005/004330

§ 371 (c)(1),
(2), (4) Date: Apr. 10, 2006

(87) PCT Pub. No.: WO2005/114774

PCT Pub. Date: Dec. 1, 2005

(65) Prior Publication Data

US 2007/0176129 A1 Aug. 2, 2007

(30) Foreign Application Priority Data

May 17, 2004 (DE) ..... 10 2004 024 367

(51) Int. Cl.
*G01J 1/32* (2006.01)

(52) U.S. Cl. ..... 250/205; 250/238; 250/551; 330/285

(58) Field of Classification Search ..... 250/551, 250/205, 238; 330/285
See application file for complete search history.

(56) References Cited

U.S. PATENT DOCUMENTS

| | | | | |
|---|---|---|---|---|
| 3,662,289 | A | 5/1972 | Dienst | 332/3 |
| 4,832,433 | A | 5/1989 | de La Chapelle et al. | 350/96.15 |
| 4,859,965 | A | 8/1989 | Paolella et al. | 330/285 |
| 5,073,717 | A | 12/1991 | Sturzebecher et al. | 250/551 |
| 5,073,718 | A | 12/1991 | Paolella | 250/551 |

(Continued)

FOREIGN PATENT DOCUMENTS

DE 37 89 229 T2 10/1994

(Continued)

OTHER PUBLICATIONS

"Analysis of Gate Lag in GaAs Metal-Semiconductor Field-Effect Transistor Using Light Illumination", Sasaki et al., J. Appl. Phys. vol. 34, 1995, pp. 6346-6351.

(Continued)

*Primary Examiner*—Seung C Sohn
(74) *Attorney, Agent, or Firm*—Marshall, Gerstein & Borun LLP

(57) ABSTRACT

An electronic microwave circuit with GaAs field-effect transistors, which are integrated onto a semiconductor substrate, for switching high frequency electrical input signals has at least one light source for illuminating the GaAs field-effect transistors. The intensity of the light source and/or the color of the light source are changeable during operation. A calibrating device calibrates the intensity and/or color of the light source using a method according to the invention.

13 Claims, 1 Drawing Sheet

U.S. PATENT DOCUMENTS

| | | | | |
|---|---|---|---|---|
| 5,086,281 | A | 2/1992 | Paolella | 330/279 |
| 5,162,657 | A | 11/1992 | Sturzebecher et al. | 250/551 |
| 5,214,275 | A * | 5/1993 | Freeman et al. | 250/551 |
| 5,313,138 | A | 5/1994 | Desmur | 315/3 |
| 5,347,235 | A | 9/1994 | Higgins et al. | 331/66 |
| 5,623,233 | A | 4/1997 | Higgins et al. | 331/37 |
| 5,808,322 | A | 9/1998 | Nicholson et al. | 257/80 |
| 6,876,271 | B2 | 4/2005 | Evers et al. | 333/81 A |
| 7,208,888 | B2 * | 4/2007 | Lovato et al. | 250/205 |
| 2004/0036462 | A1 | 2/2004 | Evers et al. | 323/369 |

FOREIGN PATENT DOCUMENTS

| | | | |
|---|---|---|---|
| DE | 698 01 177 | T2 | 3/2002 |
| DE | 102 28 810 | A1 | 1/2004 |
| EP | 869 611 | A1 | 10/1998 |
| JP | 63055978 | | 3/1988 |
| JP | 04139877 | | 5/1992 |

OTHER PUBLICATIONS

International Search Report in PCT/EP2005/004330 dated Nov. 10, 2005.

* cited by examiner

CALIBRATABLE MICROWAVE CIRCUIT WITH ILLUMINABLE GAAS-FET, CALIBRATING DEVICE AND PROCESS

BACKGROUND OF THE INVENTION

Field of the Invention

The invention relates to a microwave circuit having electronic switching components with field-effect transistors (FETs) on a substrate base made of gallium arsenide. The microwave circuit may, in particular but not exclusively, be designed as a stepped damping circuit for rapid switching of high frequency signals. The switching components or GaAs-FETs can be illuminated by a light source, whereby the light thereby falling on the field-effect transistors, in particular, substantially shortens the switching times of the field-effect transistors or of the electronic switching components.

Field-effect transistors can be very easily made on a semiconductor chip, as is known. Furthermore, they require only very little control power. Illumination of field-effect transistors on a gallium arsenide base, and particularly of metal-semiconductor field effect transistors (MESFETs), has the result that impurities which occur on the semiconductor boundary surfaces, particularly under the gate electrode and which exert a negative influence on the switching times of the field-effect transistors, are recharged more rapidly. The negative influence of the impurities is known with MESFET components as the gate-lag effect and is measurable as extremely slow alteration of the path resistance. The cause of this is the slow charging and discharging of the surface impurities in the source-gate path and the gate-drain path. Illuminating field-effect transistors generates electron-hole pairs which neutralise the charges trapped at the impurity sites. The illumination suppresses the gate-lag effect and shortens the switching time by a factor of 10 to 100.

High frequency circuits, for example, microwave circuits which are designed as damping circuits, are used, for example, in the high frequency field for measuring purposes and for level regulation in signal generators and network analyzers. In order, for example, to be able to carry out measuring sequences rapidly with various adjustable parameters, the damping circuits or the field-effect transistors used within them must be able to switch very rapidly and have a very large dynamic range. Circuits with field-effect transistors based on gallium arsenide are used, particularly because of their excellent high frequency capability and their very low switching times and, in newer circuit arrangements, these circuits are also illuminable, in particular to further shorten switching times.

For example, DE 102 28 810 A1 discloses a microwave circuit of this type. The digitally controllable damping member described there is constructed with field-effect transistors as switching elements that are illuminable by a light source, for example, an LED. The light sources are operated unregulated and controlled so as to be independent of other variables influencing the switching time of the field-effect transistors, so that, in particular, the light intensity and or the radiation energy cannot be changed during operation of the damping member.

With the microwave circuit with illuminable field-effect transistors on a gallium arsenide substrate base as disclosed in DE 102 28 810 A1, it is disadvantageous that the switching times of the field-effect transistors vary severely in operation independently of the variables influencing the field-effect transistors, such as temperature, signal voltage and control voltage.

GENERAL DESCRIPTION OF THE INVENTION

The invention provides a microwave circuit with shorter, more consistent and reproducible switching times and a corresponding calibrating device and a corresponding calibrating method.

Accordingly, the invention provides an electronic microwave circuit including GaAs field-effect transistors integrated onto a semiconductor substrate, for switching electronic high frequency input signals and at least one light source for illuminating the GaAs field-effect transistors, wherein at least one of the intensity of the light source and the color of the light source may be changed during operation.

The invention also provides a calibrating device for calibrating the intensity and/or color of a light source of an electronic microwave circuit, the intensity and/or color of the light source being changeable during operation, the microwave circuit including GaAs field-effect transistors illuminable by the light source, with a signal generator for generating high frequency input signals to a calibrating output, via which the high frequency input signals are fed to an input of the microwave circuit, with a calibrating input via which the high frequency signals altered by the microwave circuit are fed again to the calibrating device, with a control unit, for controlling the light source and the switching processes of the microwave circuit via a calibrating connection, and of the signal generator, whereby the control unit evaluates high frequency output signals input via the calibrating input and places the result of the evaluation in a store of the microwave circuit.

The invention further provides a method for operating a calibrating device of a microwave circuit of the invention including the following steps:

(a) stepwise adjusting and detecting influencing variables including intensity and/or color of the light source of the microwave circuit and at least one of the measurement variables selected from the group consisting of:

(b) the polarity of the signal voltage of the high frequency signal to be switched, relative to the control voltage with which the field-effect transistors are controlled, the size of the signal voltage of the high frequency signal to be switched, relative to the control voltage with which the field-effect transistors are controlled, the temperature of the field-effect transistors, the level of the signal voltage of the high frequency signal to be switched, and the level of the signal frequency of the high frequency signal to be switched;

(b) storing the value combinations or of the value tuples of the changed and detected values of the influencing variables and of the measurement variables (c) evaluating the value combinations or value tuples; and (d) transferring of the evaluation results to the microwave circuit.

The invention has the advantage that, with illuminable field-effect transistors, the microwave circuit can keep the switching times of the field-effect transistors particularly short and constant with little effort, so that the switching times are predictable dependent upon operating parameters. Furthermore, the power requirement of the light sources and the heating effect of the light source on the field-effect transistors is minimized.

According to a further embodiment of the invention, the microwave circuit is designed such that the light source is able to illuminate in different color alternately or simultaneously and that thereby color combinations can be created whereby the light source is able to illuminate, for example, in red, yellow, green, white, blue, ultraviolet and infrared.

According to another further embodiment of the invention, the microwave circuit has a control device which controls or regulates the intensity and/or color of the light source.

It is also advantageous if the control device controls or regulates the intensity and/or the color of the light dependent upon at least one measurement variable or a combination of measurement variables.

Through the measurement and use of the results of measuring the measurement variables of polarity of the signal voltage relative to the control voltage with which the field-effect transistors are controlled, the size of the signal voltage relative to the control voltage with which the field-effect transistors are controlled, the temperature of the field-effect transistors, the level of the signal voltage and the size of the signal frequency, the light source can be regulated or controlled particularly accurately by the control device.

In another further embodiment, the control device controls or regulates the light source in such a manner that the switching times of the field-effect transistors remain constant over the whole range of values occurring in operation, whereby the switching times are minimized.

Advantageously, the control device has a store in which the optimum intensity and/or color of the light source is stored for a plurality of values of the measurement variables, whereby the control device sets or controls the intensity and/or the color of the respective light source, based on the values stored in the store of the measurement variables used.

Advantageously, the electronic microwave circuit according to the invention has at least one sensor in the region of the respective field-effect transistor and of the respective semiconductor substrate, which detects the light intensity and/or the temperature.

The calibrating device according to the invention is capable of calibrating the color and/or intensity of the light source of the microwave circuit across settable value ranges of the measurement variables in order to make the light intensity and/or the light color optimally settable.

Advantageously, the calibrating device has a control connection for controlling a cooling/heating system for cooling or heating the field-effect transistors. The temperature of the field-effect transistors can thus be controlled and altered at will.

BRIEF DESCRIPTION OF THE DRAWINGS

The invention will now be described in greater detail based on a schematic representation using an exemplary embodiment. Matching components are provided with matching identification numbers. In the drawings.

DETAILED DESCRIPTION

Figure 1:
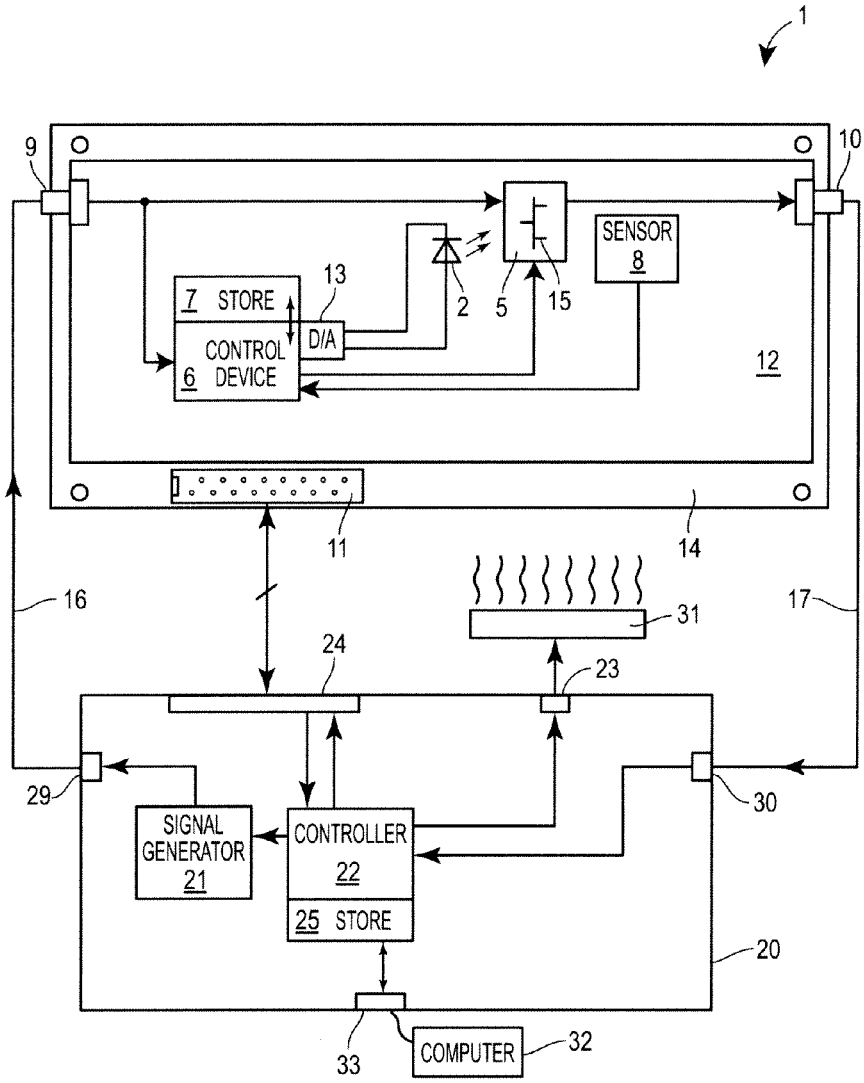
FIG. 1 shows a schematic representation of an exemplary embodiment according to the invention of a microwave circuit and a calibrating device.

FIG. 1 shows a microwave circuit 1 according to the invention, which is connected to a calibrating device 20 according to the invention.

In the exemplary embodiment, the microwave circuit 1 is designed as a damping circuit. During operation of the microwave circuit 1, for example, in a measuring arrangement (not shown), high frequency input signals 16 applied to an input 9 are fed to a circuit arrangement with GaAs field-effect switching transistors 15 and damping elements and have rapidly switchable damping applied to them. The high frequency input signals 16 are output damped to a greater or lesser extent at an output 10 as high frequency output signals 17.

The schematically represented field-effect transistors 15 are integrated onto a semiconductor chip 5 and designed as field-effect transistors 15 on a substrate base made of gallium arsenide (GaAs). The GaAs-FETs are illuminable by a light source 2, which in the exemplary embodiment is designed as a light-emitting diode. The light source 2 illuminates the GaAs-FETs, which are formed on a semiconductor chip 5 provided with its own transparent housing (not shown separately). The light source 2 is shown in the exemplary embodiment closely adjoining the semiconductor chip 5, although it may equally be arranged above the semiconductor chip 5. GaAs MESFETS can also be used.

The microwave circuit 1 is constructed on a carrier 14, which can be, for example, a printed circuit board. In the exemplary embodiment, also situated on the carrier 14 are a housing chamber 12 belonging to the microwave circuit 1, a control connection 11, a control device 6 and a sensor 8. The control device 6 also has a store 7 and a digital-to-analogue converter 13. During operation of the microwave circuit 1 designed as a damping circuit, the desired damping values are selected and set through the control device 6 via the digital control connection 11.

The switching times of the field-effect transistors 15 illuminable by the light source 2 are dependent on a series of influencing variables. In particular, the switching times are dependent on the light intensity or the illumination intensity with which the light source 2 illuminates the field-effect transistors 15, on the color of the light emitted by the light source 2, on the temperature of the field-effect transistors 15, on the size of the signal voltage to be switched by the respective field-effect transistor 15 relative to the control voltage with which the field-effect transistor 15 is controlled, whereby the signal voltage is dependent on the high frequency input signal 16, on the level of the signal frequency, which corresponds in the exemplary embodiment to the frequency of the high frequency input signal 16 and on the polarity of the signal voltage relative to the control voltage.

In most cases, it is desirable for the switching times of the field-effect transistors 15 and therefore of the microwave circuit 1 to remain constant over a wide range of influencing variable values. However, since the level of the high frequency input signals varies naturally, although the control voltage for the field-effect transistors 15 can be freely selected only within a very narrow range and the temperature of the field-effect transistors can be adapted or controlled or regulated only with a very great technical effort and only very slowly, in the exemplary embodiment according to the invention, the intensity and/or color of the light from the light source 2 is set or controlled or regulated dependent upon an influencing variable or a combination of the remaining influencing variables (designated below as measurement variables).

The light source 2 whose color and/or intensity can be altered during operation is controlled in the exemplary embodiment via the digital-to-analogue converter 13 of the control device 6 by means of a digital signal. The digital signal controls the intensity and/or the color of the light source 2. The light source 2 may be designed, for example, as a two-color LED, which is able to radiate in one of two colors or in both simultaneously. A light source 2 and/or a laser diode emitting strongly in the ultraviolet or the infrared region can also be used.

In the exemplary embodiment shown, the control device 6 sets the light intensity and/or color from the light source 2 via a D/A converter 13, dependent upon one or more of the influencing variables, for example

- the polarity of the signal voltage relative to the control voltage with which the field-effect transistors 15 are controlled,
- the size of the signal voltage relative to the control voltage with which the field-effect transistors 15 are controlled,
- the temperature of the field-effect transistors 15,
- the size of the signal voltage, and
- the level of the signal frequency, whereby, in the exemplary embodiment shown, these influencing variables are measured by the microwave circuit 1 during operation and are detected as measurement variables in the control device 6. In the exemplary embodiment shown, the D/A converter sets the voltage supply of the light source 2 concerned and therefore the current through the light source 2.

In the exemplary embodiment shown, the intensity and/or color of the light from the source 2 is regulated by the control device 6. For this purpose, a sensor 8 is provided closely adjoining the field-effect transistor 15 concerned. The sensor 8 measures the illumination intensity of the light source 2 concerned and passes it on to the control device 6. In the exemplary embodiment, the sensor 8 also measures the temperature in the region of the field effect transistor 15 concerned. In other exemplary embodiments, the sensor 8 may, for example, be integrated on the semiconductor chip 5. In further exemplary embodiments, the sensor 8 may, for example, measure only the temperature, whereby only the intensity of the light source 2 concerned can be controlled by the control device 6.

The control device 6 which, in the exemplary embodiment shown regulates the intensity and/or color of the light from the relevant light source 2 dependent upon the measurement variables, for example

- the polarity of the signal voltage relative to the control voltage with which the field-effect transistors 15 are controlled,
- the size of the signal voltage relative to the control voltage, with which the field-effect transistors 15 are controlled,
- the temperature of the field-effect transistors 15,
- the size of the signal voltage and
- the level of the signal frequency such that the switching times of the relevant field-effect transistor 15 is constant over the expected or permitted value range, selects the light intensity to be just as large as necessary and/or such that the wavelength of the light color is optimal. The heat generated and the influence of the light source 2 on the temperature of the field-effect transistor 15 is reduced thereby. Furthermore, in the exemplary embodiment shown, the light intensity and/or color is selected by the control device 6 such that the switching times of the field-effect transistor 15 concerned are as short as possible.

In the store 7 of the control device 6, for each combination of the occurring values of the measurement variables used, wherein only one measurement variable can be used, the optimal light intensity and/or color is stored. In the exemplary embodiment shown, the intensity and/or color of the light is optimally selected such that the shortest possible switching time is achieved, whereby the intensity and/or color of the light can be adjusted such that, even where the measurement variable values are unfavourable, a constant switching time can be set by regulating the color and/or intensity of the light, which is constant over all the expected or permissible values of the measurement variables.

In the exemplary embodiment shown, the microwave circuit 1 and the intensity and/or color of the light source 2 is calibrated before use, for example, in a measurement arrangement, by means of a calibrating device 20 according to the invention. The calibrating device 20 connected to the microwave circuit 1 is operated using the method according to the invention.

The calibrating device 20 essentially has a signal generator 21 and a controller (control unit) 22 with a store 25. The signal generator 21 generates the high frequency input signal 16 and passes it via a calibrating output 29 to the input 9 of the microwave circuit 1. By means of a calibrating connection 24 which is linked to the control connection 11, the controller 22 controls the microwave circuit 1 or the control device 6, whereby it switches over between the required damping values by means of digital control signals and sets the desired intensity and/or color of light. The high frequency output signal 17 is fed to the controller 22 via a calibrating input 30 linked to the output 10. Furthermore, the controller 22 controls the signal generator 21, whereby the signal generator 21 generates the high frequency input signals 16 required by the controller 22 and, optionally via a control connection 23, controls a cooling/heating system 31 for altering the temperature of the microwave circuit 1 or of the field-effect transistors 15.

The calibrating device 20 according to the invention, which is operated using the method according to the invention, now varies the influencing variables by means of the controller 22, and said influencing variables influence the switching time of the field-effect transistors 15. By means of the signal generator 21, the following are varied and set by altering the high frequency input signal 16:

- the polarity of the signal voltage relative to the control voltage with which the field-effect transistors 15 are controlled,
- the size of the signal voltage relative to the control voltage with which the field-effect transistors 15 are controlled,
- the size of the signal voltage, and
- the level of the signal frequency.

The temperature of the field-effect transistors 15 may optionally be varied and set by the controller 22 via the heating/cooling system 31. The intensity or color of the light from the light source 2 is varied and set by the controller 22 via the control connection 11 and the control device 6. By means of the temperature determined by the sensor 8 via the control device 6 and the control connection 11, the controller 22 is able to regulate the temperature of the field-effect transistors 15 and to keep it constant or alter it by controlling the heating/cooling system.

The values of the influencing variables are varied or altered step-by-step and the switching time of the relevant field-effect transistor 15 is determined for each change in that the time point of the switching command from the controller 22 is compared with the start of the damping in the high frequency output signal 17 as received by the controller 22, whereby the step widths are selectable and the value ranges of the influencing variables lie within predictable or permissible limits or are so selected. For example, one influencing variable is changed step-by-step in each case and simultaneously, the other influencing variables are kept constant. The values of the influencing variables thereby occurring are stored in the store 25 and then evaluated in that for each combination of values of the measurement variables, set values are determined for each optimal intensity and/or color of the light source 2 for which a minimal switching time can be kept constant across all possible value combinations. The evaluation is either stored first in the form of an n-dimensional table in the store 25 and then transmitted to the store 7 or is directly written into the store 7.

The controller 22 is programmable via a programming connection 33, for instance from a computer (PC) 32. Via the programming connection 33, the controller 22 can also be controlled or data can be read out of the store 25.

The invention is not restricted to the exemplary embodiment. The features of the exemplary embodiment may be combined with each other as desired.

The invention claimed is:

1. Electronic microwave circuit comprising:

GaAs field-effect transistors integrated onto a semiconductor substrate, for switching electronic high frequency input signals;

at least one light source for illuminating the GaAs field-effect transistors wherein at least one of the intensity of the light source and the color of the light source may be changed during operation; and, a control device which controls or regulates the intensity and/or the color of the light source dependent upon at least one measurement variable or a combination of measurement variables.

2. Electronic microwave circuit according to claim 1, wherein the light source is able to illuminate in different colors alternately or simultaneously.

3. Electronic microwave circuit according to claim 1, wherein the measurement variables are selected from the group consisting of:

the polarity of a signal voltage of a high frequency signal to be switched, relative to a control voltage with which the field-effect transistors are controlled, the size of a signal voltage of a high frequency signal to be switched, relative to a control voltage with which the field-effect transistors are controlled, the temperature of the field-effect transistors the size of a signal voltage of a high frequency signal to be switched, and the level of a signal frequency of a high frequency signal to be switched.

4. Electronic microwave circuit according to claim 1, wherein the control device controls or regulates the intensity and/or color of the light source in such a manner that the switching times of the field-effect transistors remain constant over an entire range of values of measurement variables used that occur in operation.

5. Electronic microwave circuit according to claim 4, wherein the intensity of the light is selected to be just large enough and/or the wavelength of the light color is optimized to be as small as possible or as energetic as possible.

6. Electronic microwave circuit according to claim 4, wherein the switching times of the field-effect transistors are minimized.

7. Electronic microwave circuit according to claim 1, wherein the control device comprises a store in which a optimum intensity and/or color of the light source dependent upon the values of the measurement variables used is stored for a plurality of values of the measurement variables, and wherein the control device sets or controls or regulates the intensity and/or the color of the respective light source, based on the values stored in the store of the measurement variables used.

8. Electronic microwave circuit according to claim 1, comprising at least one sensor in the region of the respective GaAs field-effect transistor and of the respective semiconductor substrate, for detecting the light intensity and/or the temperature.

9. Electronic microwave circuit according to claim 1, comprising a damping circuit with damping which can be switched in steps.

10. Calibrating device for calibrating the intensity and/or color of a light source of an electronic microwave circuit, the intensity and/or color of said light source being changeable during operation, said microwave circuit comprising GaAs field-effect transistors illuminable by the light source, with a signal generator for generating high frequency input signals to a calibrating output, via which the high frequency input signals are fed to an input of the microwave circuit, with a calibrating input via which the high frequency signals altered by the microwave circuit are fed again to the calibrating device, with a control unit, for controlling the light source and the switching processes of the microwave circuit via a calibrating connection, and of the signal generator, whereby the control unit evaluates high frequency output signals input via the calibrating input and places the result of the evaluation in a store of the microwave circuit.

11. Calibrating device according to claim 10, comprising a control connection for controlling a cooling/heating system for cooling or heating the field-effect transistors.

12. Method for operating a calibrating device on a microwave circuit comprising GaAs field-effect transistors integrated onto a semiconductor substrate, for switching electronic high frequency input signals and at least one light source for illuminating the GaAs field-effect transistors wherein at least one of the intensity of the light source and the color of the light source may be changed during operation, said method comprising:

(a) stepwise adjusting and detecting the influencing variables comprising intensity and/or color of the light source of the microwave circuit and at least one measurement variable selected from the group consisting of:

the polarity of the signal voltage of the high frequency signal to be switched, relative to the control voltage with which the field-effect transistors are controlled, the size of the signal voltage of the high frequency signal to be switched, relative to the control voltage with which the field-effect transistors are controlled, the temperature of the field-effect transistors, the level of the signal voltage of the high frequency signal to be switched, and the level of the signal frequency of the high frequency signal to be switched;

(b) storing the value combinations or of the value tuples of the changed and detected values of the influencing variables and of the measurement variables;

(c) evaluating the value combinations or value tuples; and (d) transferring the evaluation results to the microwave circuit.

13. Method according to claim 12, comprising evaluating the value combinations or value tuples such that an n-dimensional table is generated from which for each combination of the individual values of the measured measurement variables, the respective values of optimal light intensity and/or optimal light color can be read out.

* * * * *